United States Patent [19]

Fenton

[11] Patent Number: 5,022,652

[45] Date of Patent: Jun. 11, 1991

[54] LIGHTWEIGHT STEEL GOLF SHAFT

[75] Inventor: Frank Fenton, South Hadley, Mass.

[73] Assignee: Spalding & Evenflo Companies, Tampa, Fla.

[21] Appl. No.: 590,440

[22] Filed: Sep. 24, 1990

Related U.S. Application Data

[63] Continuation of Ser. No. 335,335, Apr. 10, 1989, abandoned.

[51] Int. Cl.[5] ..... A63B 53/12

[52] U.S. Cl. ..... 273/80 B; 273/77 A

[58] Field of Search ..... 273/77 R, 77 A, 80 R, 273/80 B; 272/104; D21/221; 29/558; 138/155; 428/36.9; 43/18.1; 280/819

[56] References Cited

U.S. PATENT DOCUMENTS

| | | | |
|---|---|---|---|
| 1,670,531 | 5/1928 | Cowdery | 273/80 B |
| 1,983,074 | 12/1934 | Durell | 273/80 B |
| 2,066,962 | 1/1937 | Cross | 273/80 B |
| 2,113,826 | 4/1938 | Carpenter | 273/80 B |
| 2,220,852 | 11/1940 | Scott | 273/80 B |
| 2,457,177 | 12/1948 | Reach | 273/80 B |
| 4,165,874 | 8/1979 | Lezatte et al. | 273/77 A |
| 4,169,595 | 10/1979 | Kaugars | 273/77 A |
| 4,330,126 | 5/1982 | Rumble | 273/80 B |
| 4,431,187 | 2/1984 | Rumble et al. | 273/80 B |
| 4,455,022 | 6/1984 | Wright | 273/77 A |
| 4,563,007 | 1/1986 | Bayliss et al. | 273/77 A |

FOREIGN PATENT DOCUMENTS

| | | | |
|---|---|---|---|
| 81/00521 | 3/1981 | European Pat. Off. | 273/80 B |
| 471020 | 8/1937 | United Kingdom | 272/80 R |
| 482164 | 3/1938 | United Kingdom | 273/80 B |

OTHER PUBLICATIONS

Blueprint for "R" Flex Iron Shaft by Bruning, Nov. 16, 1988.

Blueprint for "R" Flex Iron Shaft by Bruning, Oct. 4, 1988.

*Primary Examiner*—Edward M. Coven

*Assistant Examiner*—Sebastiano Passaniti

[57] ABSTRACT

An improved steel golf shaft formed in a generally cylindrical configuraiton with a tip end and a butt end, the shaft having a central aperture extending axially the entire length thereof, three sets of steps continuously decreasing in diameter externally and internally from the butt end to the tip end, the steps of the central set being spaced from each other by a distance greater than the distance between the steps of the other sets. Also disclosed are the matched sets of clubs, woods and irons, employing such shafts as well as their methods of fabrication.

9 Claims, 6 Drawing Sheets

LIGHTWEIGHT STEEL GOLF SHAFT

This is a continuation of copending application(s) Ser. No. 07/335,335 filed on Apr. 10, 1989, now abandoned.

BACKGROUND OF THE INVENTION

This invention relates to lightweight steel golf shafts and, more particularly, to golf clubs having lightweight steel shafts with a plurality of steps arranged in sets along the lengths of the shafts and to their methods of fabrication.

DESCRIPTION OF THE BACKGROUND ART

In the game of golf, a player holds a club at a grip at the upper or butt end and swings it so that the head at the lower or tip end hits a ball to propel it toward a hole. The game of golf has been played for hundreds of years and has produced numerous technical advancements in the ball, the golf course, and the club in an effort to lower scores and add to the enjoyment of the game. One area of particular importance is the golf club shaft, the part of the club between the grip and the head.

A large number of shaft improvements relate to materials. Shafts have been fabricated of materials such as wood, steel, glass, etc. as well as more complex and expensive composite graphite materials. Advancements in materials allow for proper strength, weight, flexibility, torque, etc.

Mechanical advancements have also been made to promote proper shaft performance. Consider shaft size, length, diameter, thickness, taper, weight distribution and steps. Steps have been long utilized for stengthening shafts along their lengths to compensate for material and weight reduction. Such stepped shafts, however, generally employ a limited number of steps spaced along the length for strengthening purposes. They are not, however, arranged in sets with pluralities of steps in each set in the manner as set forth herein for controlling the regions of torque abatement and flexibility enhancement.

While these prior art approaches discussed above, as well as the prior art patent referred to in the Information Disclosure Statement of this application, describe advantages in golf club shaft constructions, none discloses the structure by which applicant's invention may be utilized to optimize golf shaft design and performance for lower scores and greater enjoyment during a golf game.

As illustrated by a great number of prior patents and known techniques, efforts are continuously being made in an attempt to improve golf shafts and render their use more efficient, convenient, reliable and economical. None of these previous efforts, however, provides the benefits attendant with the present invention. Additionally, prior techniques do not suggest the present inventive combination of component elements as disclosed and claimed herein. The present invention achieves its intended purposes, objectives and advantages over the prior art devices through a new, useful and unobvious golf shaft which is simple to use, with the utilization of a minimum number of component parts, at a reasonable cost to manufacture, and by employing only readily available materials.

Although many such advances are noteworthy to one extent or another, none achieves the objectives of an efficient, reliable, inexpensive, golf shaft designed to accommodate the needs of a full range of clubs.

Therefore, it is an object of this invention to provide an improved golf club comprising a head section with a grip thereon, a tip section with a head thereon, and a shaft therebetween, the shaft being formed of a plurality of sets of steps along its length with decreasing diameters from the head section to the tip section, the sets of steps being spaced from each other and from the ends of the shaft.

It is another object of this invention to step golf club shafts for creating stiff and flexible sections designed to accommodate the intended movement of the golf club shaft during a player's swing.

It is a further object of the invention to abate torque in golf club shafts during a player's swing.

Lastly, it is an object of the present invention to engineer golf clubs to produce the intended action and convert the movement of a player's hands, arms and body to the action of the golf club head during the hitting of the ball.

The foregoing has outlined some of the more pertinent objects of the invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention may be incorporated into an improved golf club shaft formed of steel in a generally cylindrical configuration with a tip end and a butt end and a central aperture extending axially the entire length thereof. A plurality of sets of steps are formed on the shaft continuously decreasing in diameter externally and internally from the butt end to the tip end. About 5¼ inches to about 8¾ inches of the upper shaft adjacent to the butt end and about 9½ inches to about 12 inches of the lower shaft adjacent the tip end are of a common exterior diameter. The shaft has three spaced sets of steps and four un-stepped regions. The steps of the central region are spaced greater than the steps adjacent to the ends of the shaft. The set of steps constitutes between about 16¼ inches and 20 inches of the length of the shaft. The regions between the stepped sections constitute between about 6 inches of the length of the shaft. The shaft weighs between about 3.87 and 4.00 ounces. The shaft has a thickness of about 0.016 inches to about 0.020 inches adjacent to its ends and about 0.014 inches therebetween.

The invention may also be incorporated into an improved steel golf shaft formed in a generally cylindrical configuration with a tip end and a butt end, the shaft having a central aperture extending axially the entire length thereof, three sets of steps continuously decreasing in diameter externally and internally from the butt end to the tip end, the steps of the central set being spaced from each other by a distance greater than the distance between the steps of the other sets.

Lastly, the invention may be incorporated into an improved golf club comprising a head section with a grip thereon, a tip section with a head thereon, and a shaft therebetween, the shaft being formed of a plurality of sets of steps along its length with decreasing diameters from the head section to the tip section, the sets of steps being spaced from each other and from the ends of the shaft.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in conjunction with the accompanying drawings in which:

FIGS. 3, 4, and 5 are plan views similar to FIG. 2 but showing alternate shaft constructions.

FIGS. 7 and 8 are graphs of the results of tests performed with irons, comparing shafts of the present invention (FIG. 7) with those of conventional shafts (FIG. 8).

Similar referenced characters refer to similar parts throughout the several Figures.

DETAILED DESCRIPTION OF THE INVENTION

Figure 1:
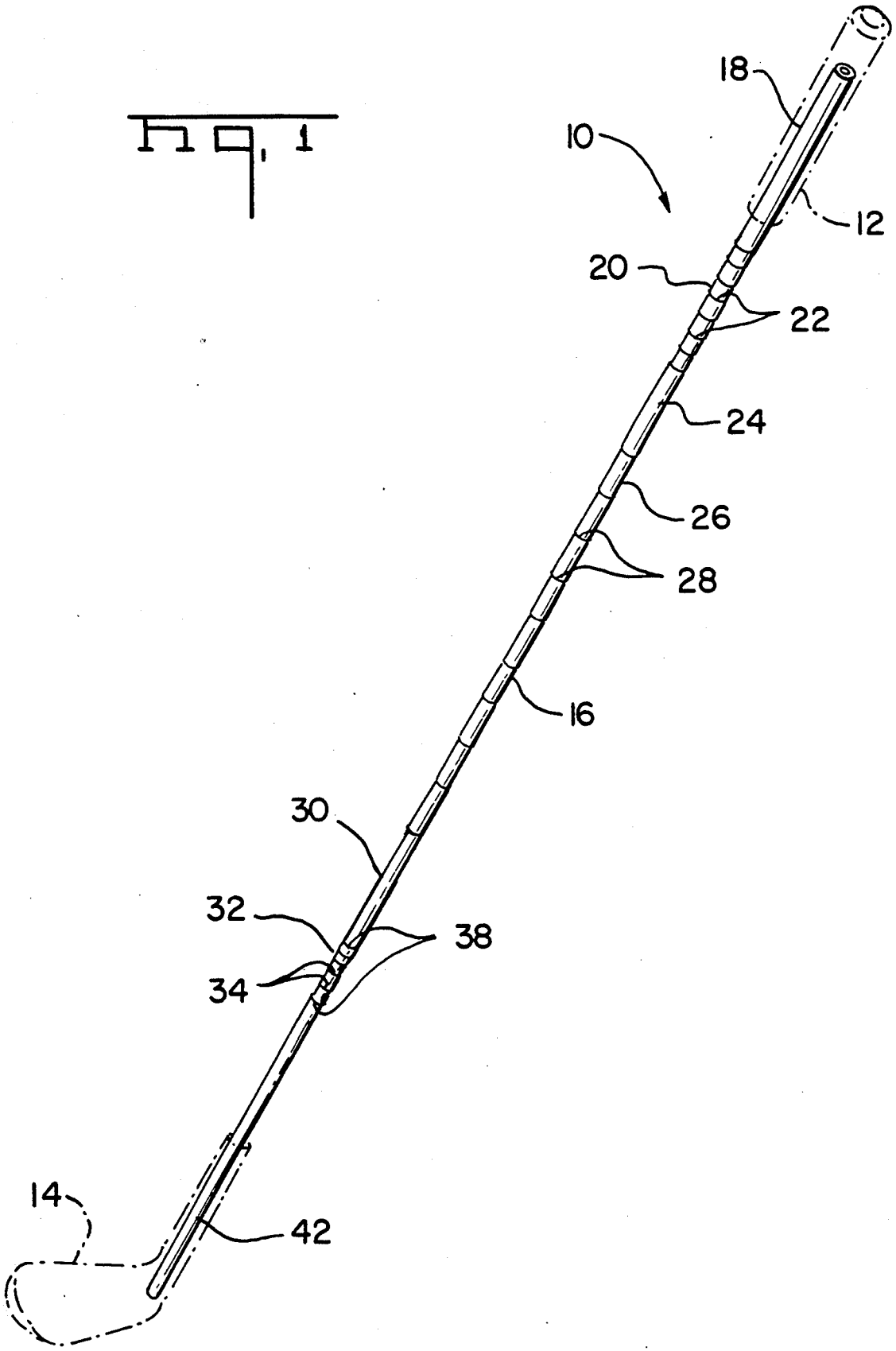
FIG. 1 is a perspective illustration of a golf club employing a shaft constructed in accordance with a primary embodiment of the present invention.
Figure 2:
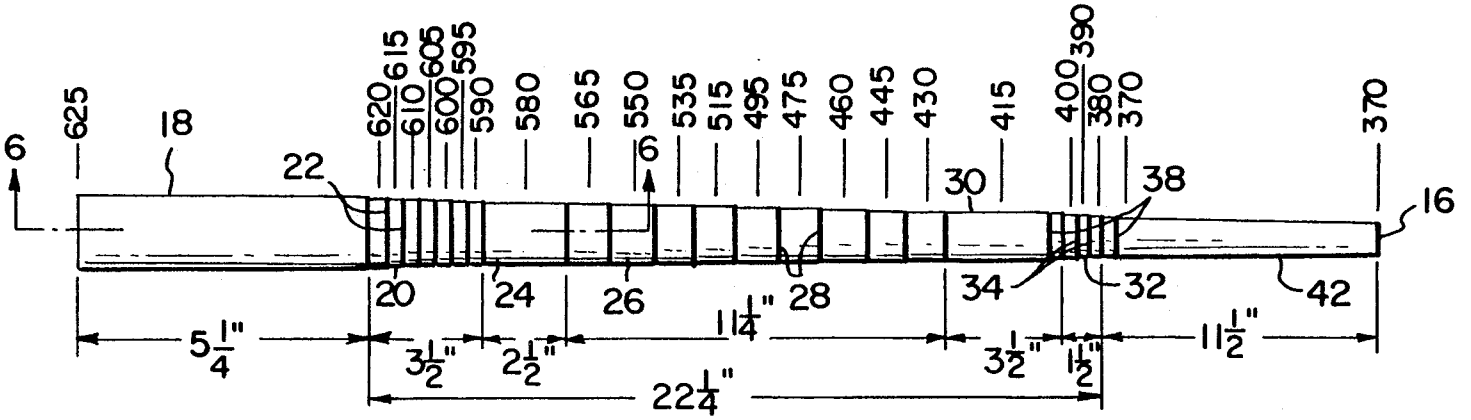
FIG. 2 is a plan view of the shaft shown in FIG. 1.
Figure 7:
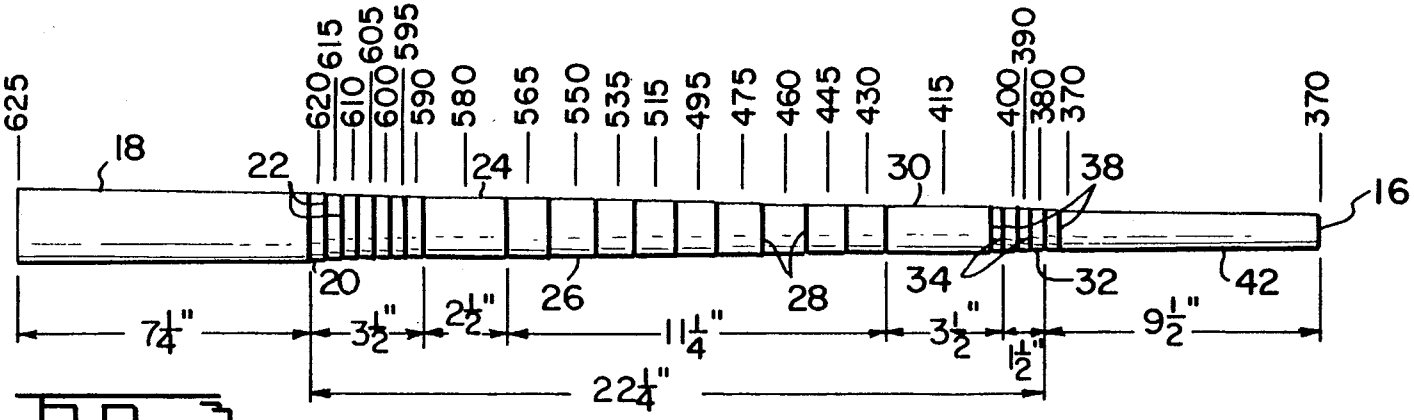

Shown in FIG. 1 is a golf club 10 having a grip 12 and head 14 coupled by a shaft 16 constructed in accordance with the principles of the present invention. The shaft of FIGS. 1 and 2 is for an iron club of regular flexibility. The upper or butt section 18 is 5¼ inches in length and 0.625 inches in exterior diameter. This second section or upper stepped section 20 is 3½ inches in length with steps 22 of ½ inch whereby the shaft decreases to 0.620, 0.615, 0.610, 0.605, 0.600, 0.595 and 0.590 inches in exterior diameters. The upper interior un-stepped section 24 is 2½ inches in length and has an exterior diameter of 0.580 inches. The central stepped section 26 is 11¼ inches in length with a plurality of widely spaced steps 28 of 1¼ inch at 0.565, 0.550, 0.535, 0.515, 0.495, 0.475, 0.460, 0.445 and 0.430 inches in exterior diameter. The next section is the lower interior un-stepped section 30 which is of a length of 3½ inches at an exterior diameter of 0.415 inches. Next comes the lower stepped section 32 which is 1½ inches in length. The diameters of the steps 34 are 0.400, 0.390 and 0.380 inches, closely spaced steps as in the upper stepped section 20. For aesthetic purposes this lower stepped section is provided with silk screen rings 38 at its extremities. Lastly, the lower or stepped section is 11½ inches in length with a common exterior diameter of 0.370 inches ending in a lower or tip section 42 for coupling with head 44.

The shaft 16 is fabricated of steel in a generally cylindrical configuration with a central aperture extending axially through the entire length thereof. The shaft is lightweight, about 3.87 ounces, plus or minus ⅛ ounce. The wall has a thickness of about 0.016 inches at the butt section 16 and 0.020 inches adjacent to the tip section 42 for greater rigidity but a thickness of about 0.014 inches therebetween for reduced weight.

The shaft is formed with three sets of steps at sections 20, 26 and 32, continuously decreasing in diameter externally and internally from the butt section 18 to the tip section 42. At least about 5¼ inches of the shaft adjacent the butt end and about 11½ inches of the shaft adjacent the tip end are not stepped and are of a common diameter internally and externally. The stepped sections constitute about 16¼ inches of the length of the shaft whereas the un-stepped sections between the stepped sections constitute about 6 inches of the shaft.

The FIG. 3 shaft is also a shaft for an iron club. It is of an identical construction to the FIG. 2 shaft except that the tip section is 2 inches shorter and the butt section is 2 inches longer. The weight is 4.00 ounces plus or minus ⅛ ounce. This effectively creates a stiffer shaft.

Figure 4:
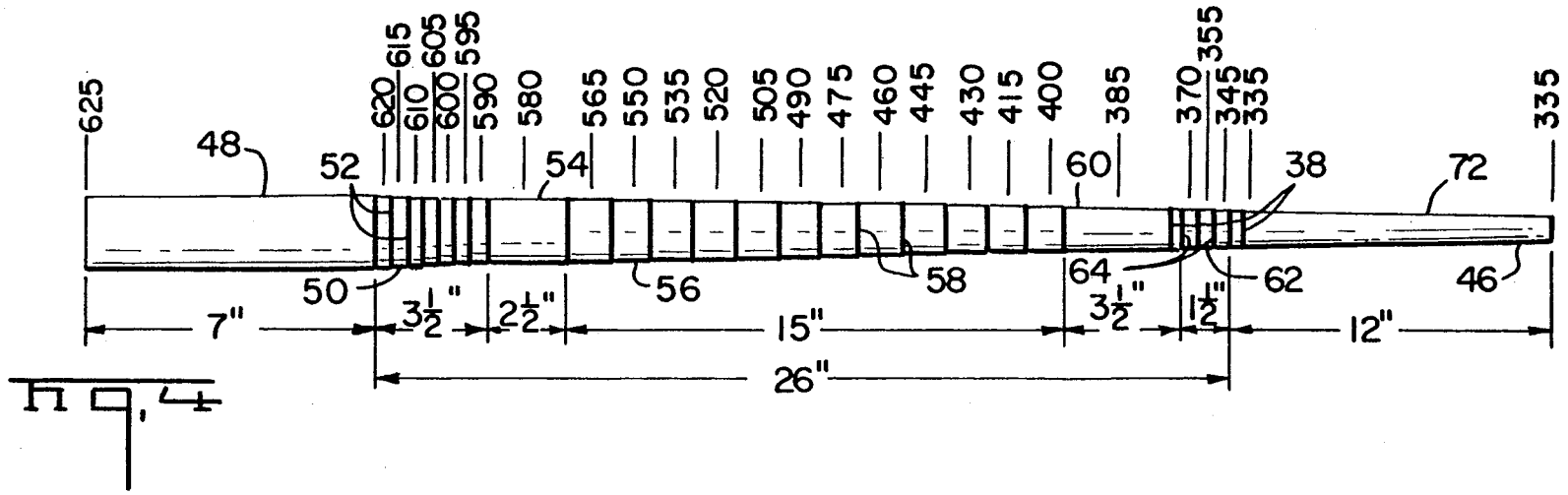

Shown in FIG. 4 is a shaft 46 also constructed in accordance with the principles of the present invention. The shaft of FIG. 4 is for a wood club of regular flexibility. The upper or butt section 48 is 7 inches in length and 0.625 inches in exterior diameter. This second section or upper stepped section 50 is 3½ inches in length with steps 52 whereby the shaft decreases to 0.620, 0.615, 0.610, 0.605, 0.600, 0.595, 0.590 and 0.585 inches in exterior diameters. The upper interior un-stepped section 54 is 2½ inches in length and has the exterior diameter of 0.580 inches. The central stepped section 56 is 15 inches in length with a plurality of widely spaced steps 58 at 0.565, 0.550, 0.535, 0.520, 0.505, 0.490, 0.475, 0.460, 0.445, 0.430, 0.415 and 0.400 inches in exterior diameter. The next section is the lower interior un-stepped section 60 which is of a length of 3½ inches at an exterior diameter of 0.385 inches. Next comes the lower stepped section 62 which is 1½ inches in length. The diameters of the steps 64 are 0.370, 0.355, and 0.345 inches, closely spaced steps as in the upper stepped section 50. For aesthetic purposes this lower stepped section is provided with silk screen rings 38 at its extremities. Lastly, the lower or stepped section is 12 inches in length with a common exterior diameter of, 0.335 inches ending in a lower or tip section 72.

The shaft 46 is also fabricated of steel in a generally cylindrical configuration with a central aperture extending axially through the entire length thereof. The shaft is lightweight, about 3.87 ounces, plus or minus ⅛ ounce. The wall has a thickness of about 0.016 inches at the butt section 76 and and a thickness of about 0.020 inches adjacent to the tip section 42 for greater rigidity but a thickness of about 0.014 inches therebetween for reduced weight.

The shaft 46 is formed with three sets of steps at section 50, 56 and 62, continuously decreasing in diameter externally and internally from the butt section 48 to the tip section 72. At least about 7 inches of the shaft adjacent to the butt end and about 12 inches of the shaft adjacent the tip end are not stepped and are of a common diameter internally and externally. The stepped sections constitute about 20 inches of the length of the shaft whereas the un-stepped sections between the stepped sections constitute about 55½ percent of the shaft.

Figure 5:
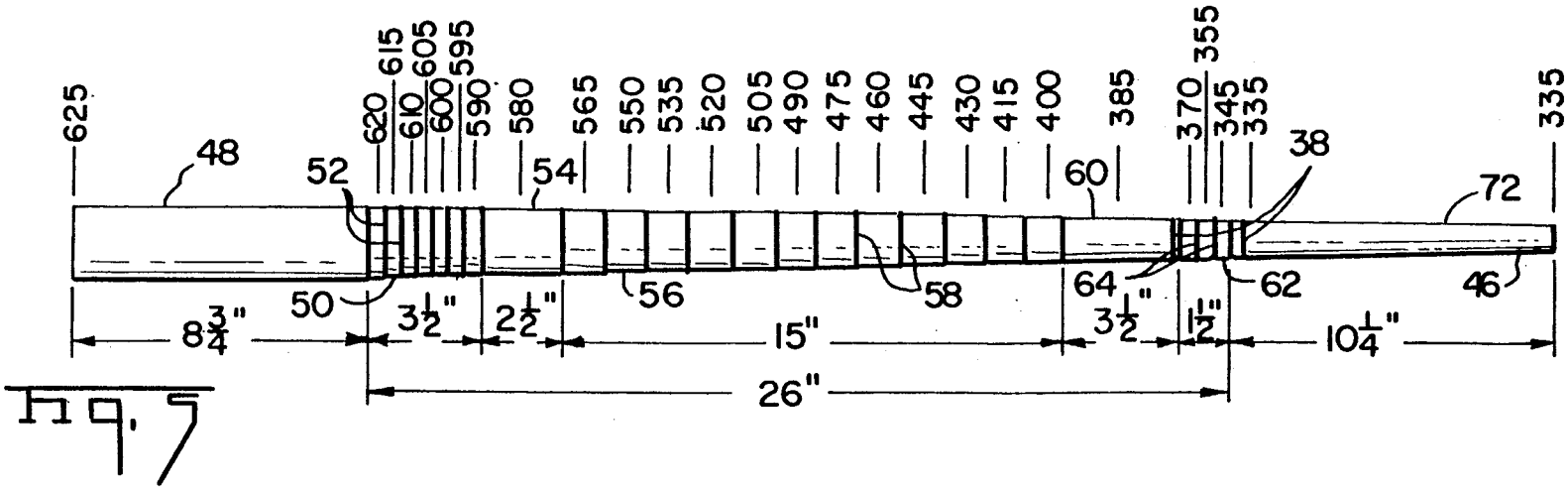

The FIG. 5 shaft 46 is also a shaft for a wood club. It is of an identical construction to the FIG. 4 shaft except that the tip section is 1¾ inches shorter while the butt section is 1 ¾ inches longer. The weight is 4.00 ounces plus or minus ⅛ ounce. This effectively creates a stiffer shaft.

Figure 6:
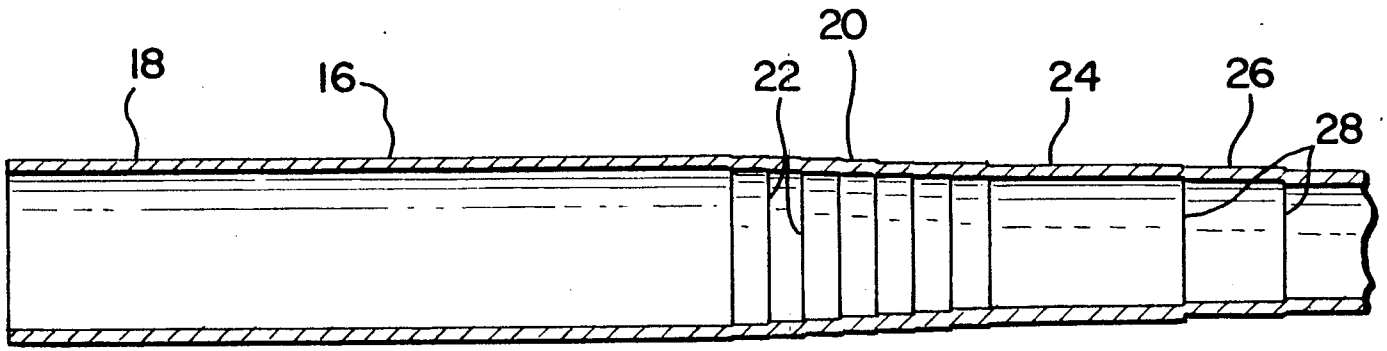
FIG. 6 is an enlarged sectional view taken along line 6—6 of FIG. 2.
Figure 6:
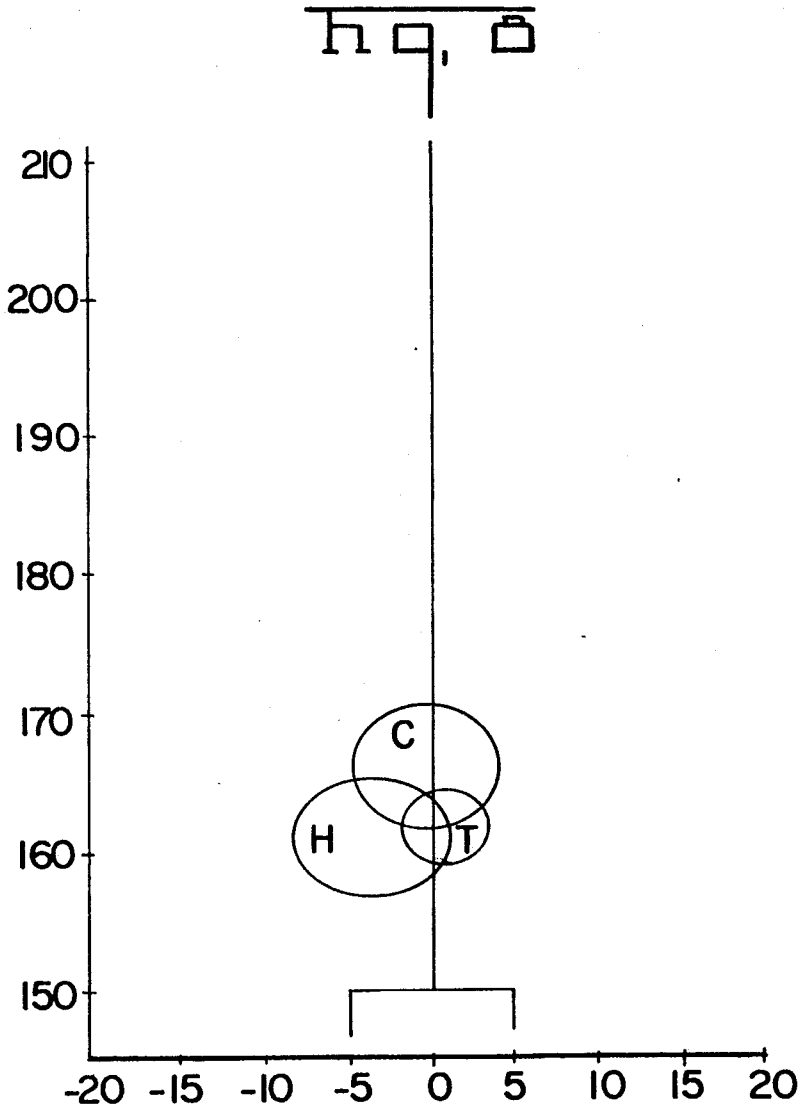
Figure 7:
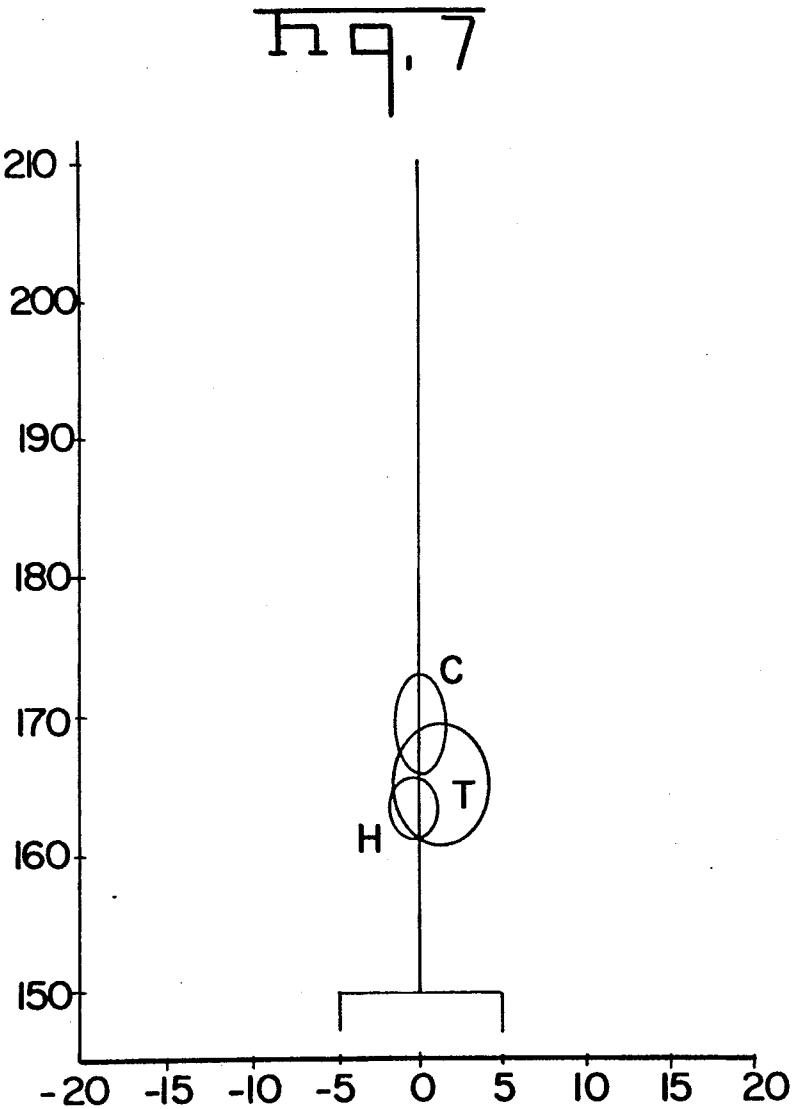
Figure 10:
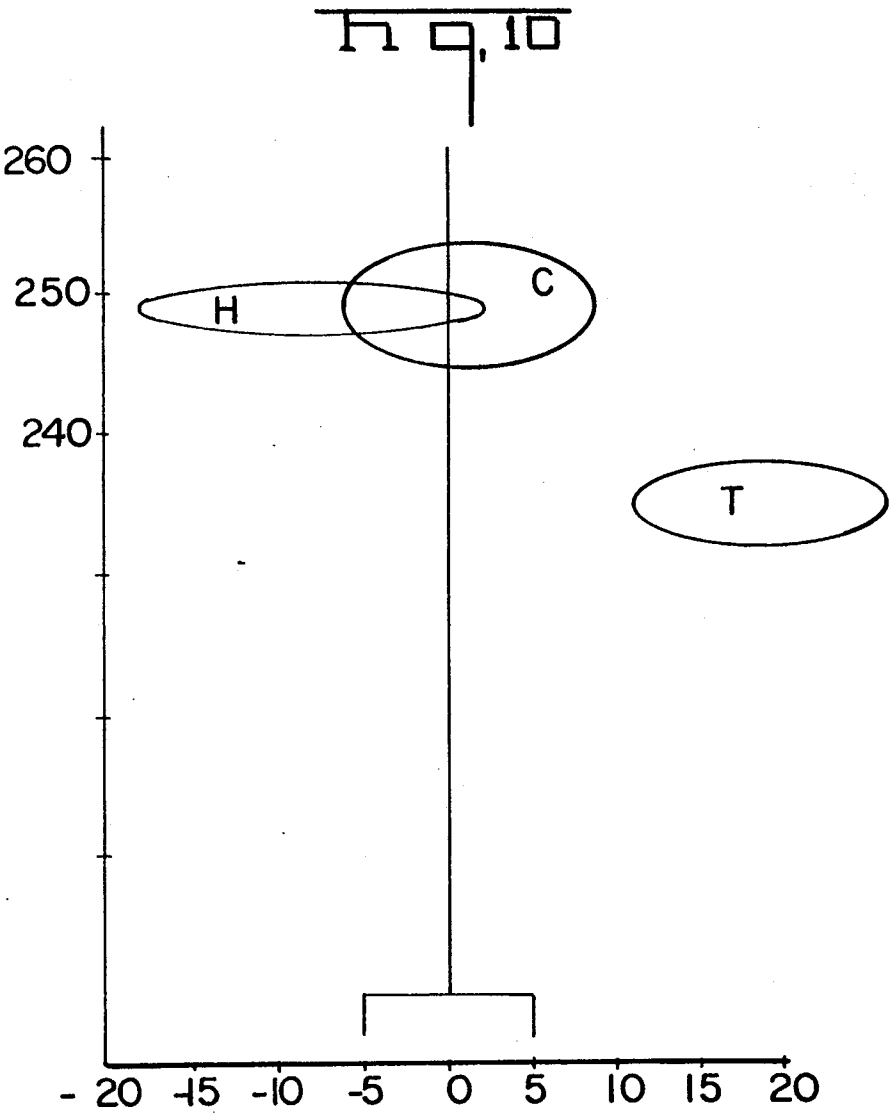
FIGS. 9 and 10 are graphs of the results of tests similar to FIGS. 7 and 8 but of tests performed with woods, comparing the shaft of the present invention (FIG. 9) with those of conventional woods (FIG. 10).
Figure 9:
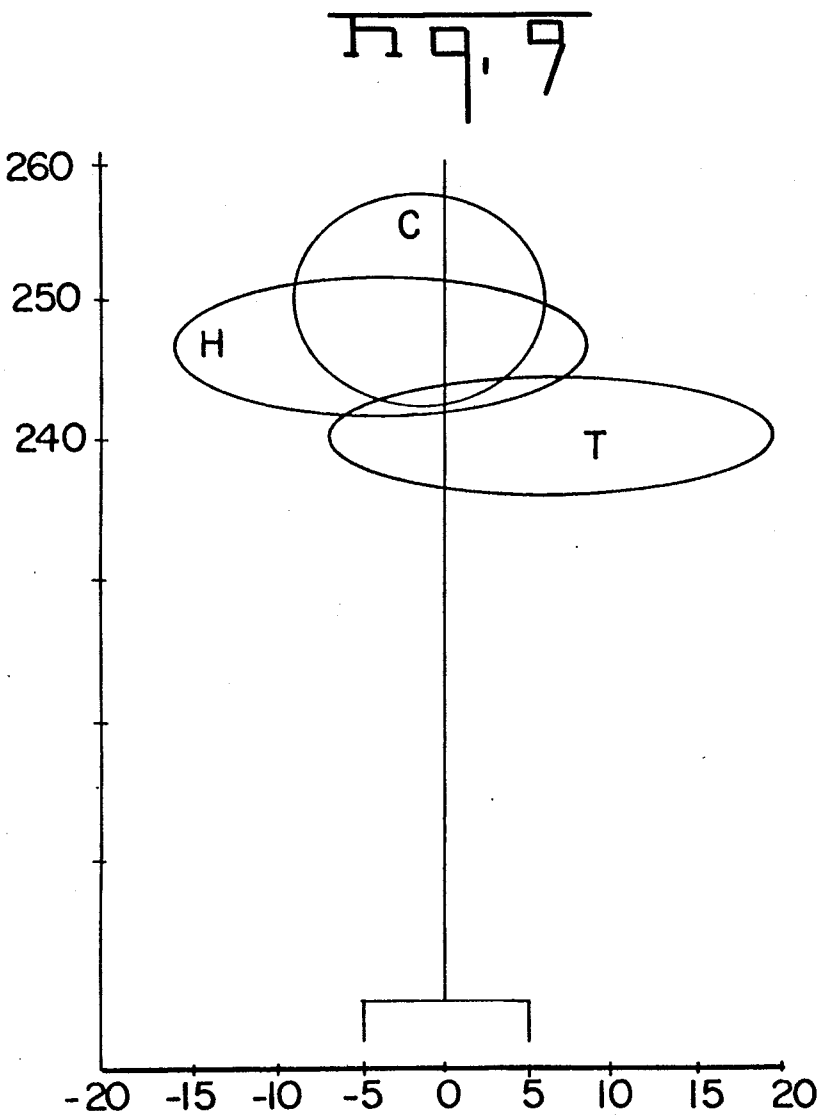

Greater detail of the shaft can be seen with reference to the cross-sectional illustration in FIG. 6. Each step reduces the diameter of the shaft interiorly and exteriorly in the direction from the butt end to the tip end. At each step, the shaft is formed with curves forming a smooth radius during the conventional fabrication technique.

Golf clubs provided with shafts in accordance with the present invention are lightweight steel golf shafts with a slightly larger and stiffer butt than standard to remove the flex from the butt area of the shaft and to create more kick lower in the shaft for ease in launching the ball. The shaft tip is not designed with a small weak tip that would create unwanted whipiness. In fabricating a matched set of clubs, the shafts as described above are cut or trimmed from the tip end to an appropriate amount to couple with appropriate heads 14 for creating matched sets of clubs. The progressively trimmed shaft tips create a matched set of golf shafts which allow the long irons to have more kick than conventionally designed steel shafts, the mid irons somewhat more kick than conventionally designed steel shafts, and the short irons an average amount of kick when compared to conventional steel shafts.

The same tip trimming concept is used to also fabricate a matched set of shafts for golf woods. The longest wood has the most kick, the next longest has the next most kick, etc. while the shortest wood is more conventional in its kick.

Using golf clubs with exactly the same loft, lie, length, and swing weight on the irons and the exact same loft, lie, face angle, roll, bulge length, and swing weight on the woods, a test was conducted with a robotic golfer to determine any difference in performance comparing the shaft of the present invention against a control of the most popular weight steel shaft.

The same power source, swing speed, set up and standard test balls were used. A series of face scanning hits were performed in a center hit, toe hit, center hit, heel hit, etc. sequence to show the scatter of shots that would occur from these different types of hits that would simulate the tendencies of live golfers.

The test results are as follows:

| | Distance | Avg. Lateral Deviation from Center Line (Yds.) |
|---|---|---|
| Control Club with Standard Steel Shaft #5 Iron | | |
| Center Hit | 166 | .5 left |
| Toe Hit | 162 | .8 right |
| Heel Hit | 161 | 3.6 left |
| Present Invention | | |

-continued

| | Distance | Avg. Lateral Deviation from Center Line (Yds.) |
|---|---|---|
| #5 Iron | | |
| Center Hit | 169 | .1 right |
| Toe Hit | 165 | 1.3 right |
| Heel Hit | 164 | .45 left |
| Control Club with Standard Steel Shaft #1 Wood | | |
| Center Hit | 250 | 1.4 right |
| Toe Hit | 236 | 18.6 right |
| Heel Hit | 250 | 7.7 left |
| Present Invention #1 Wood | | |
| Center Hit | 256 | 1.5 left |
| Toe Hit | 247 | 6.3 right |
| Heel Hit | 253 | 3.8 left |

As we can see from the distance results, the #5 iron of the present invention outdistanced the control #5 iron by 3 yards on each impact point on the club face. The "spread, " average farthest shot left added to the average farthest shot right, is shown to be 4.4 yards for the control club versus a much tighter or more accurate shot by 1.75 yards for the #5 iron of the present invention. The wood club results show greater distance produced by the shafted club of the present invention by 3 to 11 yards, depending on the impact point on the club face. The "spread" for the control club is 26.3 yards versus a very much tighter 10.1 yards with the shafted wood of the present invention.

Computer generated elipses are attached to show the landing locations of the golf balls hit by each club. "H", "T", and "C" indicate the landing areas of the balls hit on the heel, toe and center of the head, respectively. The larger the elipses, the less accurate the club hits were. The larger the spread of all the elipses together, the less accurate the club hits were. The data and the elipses both clearly show that the shafted clubs of the present invention were longer and more accurate in producing their hits.

The shaft is lightweight to create easier swings and increased club head speed. The club's overall weight is nearly as light as a club with a high modulus graphite shaft due to a joint usage of the present inventive lightweight shaft and a lighter than conventional weight grip. Even with the lighter overall weight, conventional swing weights are achieved.

The butt of a shaft of the present invention is firmer than conventional shafts to remove any unnecessary flex in the hands area, thus creating a slightly lower flex point without the need for a whippy flexible tip design.

The long iron shafts are designed to have the most amount of kick to aid in achieving proper ball trajectory, while the mid-irons exhibit some increased kick and the short irons, the scoring clubs, yield firmer more conventional feel.

The shaft of the present invention has been proven to be slightly longer in carry than conventional shafts but its greater attribute is its extreme accuracy versus standard steel and even the expensive high modulus graphite shafts. The landing area from balls hit with shafts of the present invention are half that of other conventional shafts.

The herein described lightweight steel golf shafts may be used in any golf clubs. Superior results are realized during use. Particularly superior results are realized when the herein described shafts are used with golf clubs having the grip as set forth in my co-pending U.S. patent application Ser. No. 07/335,334 filed concurrently herewith.

The present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A golf club shaft formed of steel in a generally cylindrical configuration with a tip end and a butt end, the shaft having a central aperture extending axially the entire length thereof, three longitudinally stepped regions along each of which a series of axially, essentially equidistant steps are defined, one of said regions forming a central region between the other two stepped regions and directly between each of two said stepped regions is defined an unstepped region greater in axial length than the axial length between the steps of the stepped regions in order to form a stepped shaft pattern, the stepped shaft pattern being formed along the shaft continuously and decreasing in diameter both externally and internally from the butt end to the tip end, with about 5¼ inches to about 8¾ inches of the upper shaft adjacent to the butt end being of a first common interior and exterior diameter and with about 9½ inches to about 12 inches of the lower shaft adjacent the tip end being of a second common interior and exterior diameter.

2. The shaft as set forth in claim 1 wherein the steps of the central region are spaced from each other along the longitudinal axis of the shaft a distance greater than the distance between the steps adjacent to the ends of the shaft.

3. The shaft as set forth in claim 2 wherein the total length of all the steps constitutes between about 16¼ inches and about 20 inches of the length of the shaft.

4. The shaft as set forth in claim 3 wherein total length of all the regions between all the steps constitutes about 6 inches of the length of the shaft.

5. The shaft as set forth in claim 1 wherein the shaft weighs between about 3.87 and 4.00 ounces plus or minus ⅛ ounce.

6. The shaft as set forth in claim 5 wherein the shaft has a thickness of about 0.016 inches adjacent to its butt end and about 0.020 inches adjacent to its tip end and about 0.014 inches therebetween.

7. A steel golf club shaft formed in a generally cylindrical configuration with a tip end and a butt end, the shaft having a central aperture extending axially the entire length thereof, three longitudinally stepped regions along each of which a series of axial steps are defined, one of said regions forming a central region between the other two stepped regions, and directly between each of the said stepped regions is defined an unstepped region greater in axial length than the axial length between steps of the stepped region, in order to form a stepped shaft pattern, the stepped shaft pattern being continuously decreasing in diameter externally and internally from the butt end to the tip end, the steps of the central region being spaced from each other along the longitudinal axis of the shaft by a first distance greater than a second distance between the steps of the other sets.

8. A golf club comprising a butt section with a grip thereon, a tip section with a head thereon and, therebetween, a shaft formed in a generally cylindrical configuration with a tip end and a butt end, the shaft having a central aperture extending axially the entire length thereof with three longitudinally stepped regions along each of which a series of axial steps are defined, one of said regions forming a central region between the other two stepped regions and directly between each of two said stepped regions is defined an unstepped region greater in axial length than the axial length between steps, of the stepped regions in order to form a stepped shaft pattern, the stepped shaft pattern being continuously decreasing in diameter externally and internally from the butt end to the tip end, the steps of the central region being spaced from each other along the longitudinal axis of the shaft by a distance which is greater than the distance between the steps of the other sets.

9. A golf club having a handle, shaft and clubhead, said shaft comprising:

a) a central aperture extending axially the entire length thereof;

b) a first extreme end forming a butt end of said club from which an upper shaft portion of a first common exterior diameter extends for an axial length of about 5¼ inches to 8¾ inches inwardly from said butt end to a first point;

c) a tip end opposite said butt end form which a lower shaft portion of a second common exterior diameter, smaller than said first exterior diameter, extends for an axial length of about 9½ inches to 12 inches inwardly from said tip end to a second point;

d) a portion of said shaft extending axially inwardly of said first and second points and defining a first and second set, respectively, each set having steps spaced apart at equal axial lengths therealong, each set terminating at an end point;

e) a central set intermediate an axially inwardly distant from said end points, said central set having steps spaced therealong at equal axial lengths, the axial length between each step of the central set being greater than the axial length between the steps of said first and second sets;

f) said steps of said first, second and central sets decreasing in diameter externally and internally from said first point to said second point to form a tapered stepped pattern and an unstepped region defined directly between the central set and each of the first set and the second set and being greater in axial length than the length between the steps of the first set and the second set.

* * * * *